US005540776A

United States Patent [19]

Habsburg-Lothringen

[11] Patent Number: 5,540,776

[45] Date of Patent: Jul. 30, 1996

[54] APPARATUS FOR APPLYING A POWDERED COATING TO A WORKPIECE

[75] Inventor: Sandor Habsburg-Lothringen, Hernstein, Austria

[73] Assignee: Axis USA, Inc., Tampa, Fla.

[21] Appl. No.: 286,381

[22] Filed: Aug. 4, 1994

Related U.S. Application Data

[63] Continuation-in-part of Ser. No. 967,861, Oct. 28, 1992, abandoned, which is a continuation of Ser. No. 661,830, Feb. 27, 1991, Pat. No. 5,179,910.

[51] Int. Cl.[6] ..... B05B 5/025; B05C 13/00

[52] U.S. Cl. ..... 118/634; 118/50.1; 118/56; 118/309; 118/500; 118/503; 118/621; 118/630; 118/635; 118/636

[58] Field of Search ..... 118/50, 50.1, 63, 118/309, 312, 326, 303, 305, 308, 425, 500, 602, 621, 631, 630, 629, 634, 635, 636, 642, DIG. 5, DIG. 7

[56] References Cited

U.S. PATENT DOCUMENTS

| | | | |
|---|---|---|---|
| 1,520,796 | 12/1924 | Bartling | 118/DIG. 7 X |
| 2,756,719 | 7/1956 | Pesek et al. | 118/503 |
| 3,244,144 | 4/1966 | Goodwin et al. | 118/312 |
| 3,261,707 | 7/1966 | Korski et al. | 118/DIG. 5 |
| 3,291,630 | 12/1966 | Deyle et al. | 118/312 X |
| 3,311,085 | 3/1967 | Smith | 118/312 X |
| 3,355,309 | 11/1967 | Bender et al. | 117/18 |
| 3,355,310 | 11/1967 | De Jean et al. | 117/18 |
| 3,431,887 | 3/1969 | Pettigrew et al. | 118/11 |
| 3,440,078 | 4/1969 | Sharetts | 118/505 X |
| 3,527,502 | 9/1970 | Graham | 302/42 |
| 3,670,699 | 6/1972 | Sargent | 118/629 |
| 3,802,380 | 4/1974 | Ford et al. | 118/627 |
| 3,809,011 | 5/1974 | Fabre et al. | 118/635 |
| 3,865,610 | 2/1975 | Goodridge et al. | 117/17 |
| 3,889,015 | 6/1975 | English | 118/DIG. 5 X |
| 3,901,185 | 8/1975 | Goodridge et al. | 118/630 |
| 3,921,574 | 11/1975 | English | 118/106 |
| 4,022,155 | 5/1977 | Campagna et al. | 118/423 |

(List continued on next page.)

FOREIGN PATENT DOCUMENTS

| | | | |
|---|---|---|---|
| 0974049 | 9/1975 | Canada . | |
| 2649912 | 1/1991 | France . | |
| 1025492 | 4/1966 | United Kingdom . | |
| 79/00756 | 10/1979 | WIPO . | |
| 0000756 | 10/1979 | WIPO | 118/DIG. 5 |

OTHER PUBLICATIONS

Strucaly, M. "Conformal Integral Insulation for Line Voltage Motors," *Electrical Manufacturing*, Jul. 1989.

"The Aumann Production line AFS for manufacturing armatures for universal motors," pp. 43–45 (undated).

Electrostatic Technology Inc., New Haven Connecticut, "Integral Insulation of Motor Iron," brochure (undated).

*Primary Examiner*—David A. Simmons
*Assistant Examiner*—M. Curtis Mayes
*Attorney, Agent, or Firm*—Fish & Neave; Robert W. Morris; Garry J. Tuma

[57] ABSTRACT

Apparatus for applying powdered coating to a workpiece—particularly to electric motor armatures and stators—including features relating to handling and masking of workpieces before, during and after coating, is provided. A first feature of the invention is the inclusion of all coating steps—e.g., coating, cleaning and precuring—as modules in a single treatment station on the production line. The treatment station can also be enclosed in a single housing to contain excess powder from both the coating and cleaning processes, so that a single powder recovery system can be used to recover the excess powder from both processes. The invention also includes a handling system for removing the workpiece from the production line, inserting it into the treatment station and moving it past the various modules in the treatment station, withdrawing it from the treatment station, and returning it to the armature production line. The handling system includes unique, self-locking gripping means, as well as automatic masking means, which are preferably integral with one another.

14 Claims, 8 Drawing Sheets

U.S. PATENT DOCUMENTS

| | | | |
|---|---|---|---|
| 4,230,068 | 10/1980 | Itoh et al. | 118/634 |
| 4,319,543 | 3/1982 | Shank | 118/503 |
| 4,321,281 | 3/1982 | Itoh . | |
| 4,517,219 | 5/1985 | Hajek | 427/8 |
| 4,567,818 | 2/1986 | Napadow | 118/326 X |
| 4,662,309 | 5/1987 | Mulder | 118/326 X |
| 4,787,330 | 11/1988 | Bolf | 118/DIG. 7 X |
| 4,879,970 | 11/1989 | Barkalow et al. | 118/326 X |
| 5,127,574 | 7/1992 | Mosser et al. | 118/309 X |
| 5,296,031 | 3/1994 | Seiler et al. | 118/312 X |

APPARATUS FOR APPLYING A POWDERED COATING TO A WORKPIECE

CROSS REFERENCE TO RELATED APPLICATIONS

This application is a continuation-in-part of commonly-assigned U.S. patent application Ser. No. 07/967,861, filed Oct. 28, 1992, now abandoned, which was a continuation of commonly-assigned U.S. patent application Ser. No. 07/661,830, filed Feb. 27, 1991, now U.S. Pat. No. 5,179,910.

BACKGROUND OF THE INVENTION

This invention relates to apparatus for applying a powdered coating to a workpiece. More particularly, this invention relates to apparatus for applying a heat-curable powdered coating to an electric motor component. Most particularly, this invention relates to apparatus for electrostatically applying an insulating coating to electric motor armatures and stators.

It is a common practice to insulate electric motor winding parts—i.e., armatures and stators—with a resinous or epoxy coating applied in the form of a powder. The motor part is either heated before powder application, so that the coating fuses on contact and flows into a more or less uniform layer, or the motor part is heated after powder application to fuse the coating.

One popular technique for assuring the desired regularity of powder application is to apply the powder using electrostatic methods. In these methods, the motor part is grounded and charged powder particles are deposited electrostatically. One electrostatic deposition method is to place the grounded motor part in a fluidized bed of powder particles suspended in a flow of ionized air. Another method uses electrostatic spray devices. A major advantage of electrostatic methods is that areas that need thicker than normal insulating coatings because they tend to develop more intense electric fields—e.g., corners—receive thicker coatings for the very same reason, as the more intense electric fields in those areas cause more particles to be deposited.

Fluidized bed coating is generally employed where the desired coating is relatively thick and relatively uniform, and where an even demarcation is desired between coated and uncoated areas. Fluidized bed coating is particularly useful where the object to be coated has reentrant portions that cannot be reached by direct spraying.

On the other hand, in cases where only isolated areas of the workpiece need to be coated, spray coating can be employed, even though it involves higher equipment costs and higher tolerance deviation in the finished coating. To the extent that both methods require recovery of unused powder, spray coating also has higher powder recovery costs. Spray coating can use electrostatic or non-electrostatic sprays.

In another known type of coating process, the workpiece is preheated before the powder is applied, so that it immediately fuses at least sufficiently to be retained on the workpiece.

In any type of coating process, before the actual coating step, the workpiece is cleaned to remove any dirt, grease, or other foreign matter such as solutions used on the workpiece to facilitate cutting or stamping. The workpiece is then masked to cover any areas that should not be coated. For example, in the case of an electric motor part, there may be areas where it will be necessary to make electrical contact for proper functioning of the motor or, more likely, there will be areas—such as the armature shaft—where the coating would result in too high a coefficient of friction, or where it would increase the dimensions of the coated piece to the point that it would no longer meet the necessary clearances—such as the rounded outer surface of the armature. If such areas are not masked, it may be possible to remove the powdered coating before the powder is fused by heating. However, in some cases the areas to be kept clean are difficult to reach with powder removal or cleaning devices, so it is easier to mask those areas to prevent powder deposition in the first place.

While automatic mask-applying devices are known, it may be difficult to apply masks automatically to certain areas. As a result, automatic mask-applying devices may be unnecessarily complex and therefore unnecessarily expensive.

Just as the workpiece must be treated before coating, it must also be treated after coating and before curing to remove, or clean, excess or undesired powder from areas where the workpiece should not be coated. Known cleaning techniques include use of vacuum, brushing, scraping, or wiping with open-cell foam material similar to sponge. These techniques require special handling of the workpiece to assure that the correct areas of the workpiece are presented to the cleaning devices. These techniques also require relative motion between the workpiece and the device, as well as powder recovery equipment to capture the removed powder (except in the case of vacuum cleaning applications which are in and of themselves recovery applications). Of course, if the preheating type of application technique is used, any powder applied cannot be removed, so no cleaning step is performed.

After cleaning, the workpiece is frequently heated sufficiently to set the coating to prevent its being dislodged in further handling, although this step may be omitted in some applications, and is always omitted where preheating was used. When such a "precuring" step is used, it is usually carried out by infrared, microwave or induction heating, requiring, in some cases, that the workpiece be placed in particular alignments for proper heating.

If precuring is not used, the masks cannot be removed prior to final curing without the possibility of dislodging powder from areas to be coated. However, after precuring, the masks may be removed and the workpiece heated to transform the coating into its desired final state. This final curing step can be carried out in different types of equipment, and sometimes includes a controlled cooling step after heating. Final curing occurs immediately after coating where the preheating technique is used, as the other intermediate steps are neither necessary nor possible.

Known apparatus for carrying out all of the steps of coating processes as described above is large, usually being made up of a number of separate units, requiring complex handling as the workpiece is removed from the production line for treatment at the various units. In addition, each unit has its own support equipment, such as, in particular, its own excess powder recovery system, requiring the moving of large volumes of air to recover excess powder.

It would be desirable to be able to provide apparatus for carrying out coating of workpieces that is relatively compact, with as few separate stations as possible.

It would also be desirable to be able to provide a common excess powder recovery system for the various units of the apparatus, to reduce the volume of air that must be handled.

It would further be desirable to be able to provide for simplified and efficient handling of the workpieces as they are removed from the production line, treated, and returned to the production line.

It would still further be desirable to be able to provide such handling apparatus that can position the workpieces relative to the various units of the apparatus.

It would yet further be desirable to be able to provide a more efficient cleaning unit for such apparatus.

Finally, it would be desirable to be able to provide simplified automatic masking and unmasking devices for such apparatus.

SUMMARY OF THE INVENTION

It is an object of this invention to provide apparatus for carrying out coating of workpieces that is relatively compact, with as few separate stations as possible.

It is also an object of this invention to provide a common excess powder recovery system for the various units of the apparatus, to reduce the volume of air that must be handled.

It is a further object of this invention to provide for simplified and efficient handling of the workpieces as they are removed from the production line, treated, and returned to the production line.

It is a still further object of this invention to provide such handling apparatus that can position the workpieces relative to the various units of the apparatus.

It is yet a further object of this invention to provide a more efficient cleaning unit for such apparatus.

Finally, it is an object of this invention to provide simplified automatic masking and unmasking devices for such apparatus.

In accordance with this invention, there is provided apparatus for application of a powdered heat-curable coating to a workpiece. The apparatus comprises electrostatic coating means for applying the powdered coating to the workpiece, cleaning means for removing excess or undesired powdered coating from areas of the workpiece after coating of the workpiece by the electrostatic coating means, and powder recovery means common to both the electrostatic coating means and the cleaning means for recovering both excess powdered coating from the coating means and removed powdered coating from the cleaning means.

There is also provided such apparatus comprising coating means for applying the powdered coating to the workpiece, cleaning means for removing excess or undesired powdered coating from areas of the workpiece after coating of the workpiece by the coating means, and means for translating the workpiece past the cleaning means in a first direction along a translation plane and for presenting to the cleaning means an area of the workpiece from which it is desired to remove the powdered heat-curable coating. The cleaning means comprises a vacuum chamber having walls substantially perpendicular to the translation plane. The vacuum chamber is divided into a plurality of vacuum plena by a plurality of dividers. The dividers are parallel to one another, perpendicular to the translation plane, and at an oblique angle relative to the first direction.

There is further provided such apparatus comprising conveyor means for conveying the workpiece through the apparatus, a treatment station including coating means, the coating means being a module of the treatment station, and transfer means for removing the workpiece from the conveyor, inserting the workpiece into the treatment station in a first direction, translating the workpiece past the module in the first direction, withdrawing said workpiece from the treatment station in a second direction opposite to the first direction, and returning the workpiece to the conveyor.

There is still further provided such apparatus comprising a treatment station including coating means, the coating means being a module of the treatment station, and means for gripping the workpiece.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
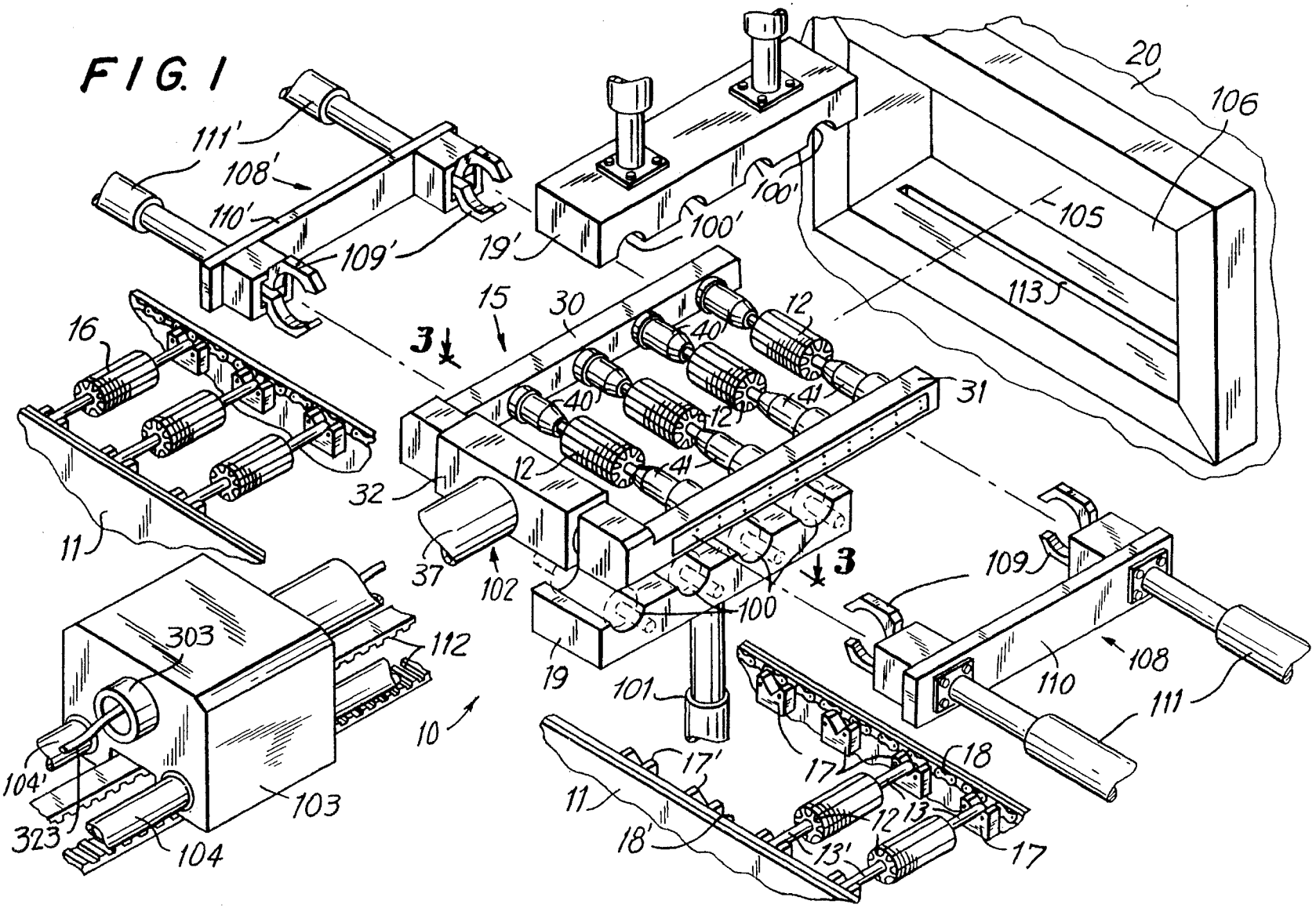
FIG. 1 is a partially fragmentary perspective view of a preferred embodiment of apparatus according to the present invention.

The present invention will be described below in the context of fluidized bed electrostatic coating of electric motor armatures. However, the present invention is not limited to that type of coating, nor to that type of workpiece. The present invention includes features relating to handling and masking of workpieces—including electric motor winding parts and other types of workpieces—before, during and after coating, and these features are applicable to other types of coating as well.

A first feature of the invention is the inclusion of all coating steps—e.g., coating, cleaning and precuring—in a single treatment station on the armature production line. In the case of electrostatic coating in particular, coating, cleaning and precuring equipment can be supplied as modules of the treatment station. The treatment station can also be enclosed in a single housing to contain excess powder from both the coating and cleaning processes, so that a single powder recovery system can be used to recover the excess powder from both processes, instead of separate systems as previously known.

Whatever modules are necessary for the type of coating technique being used can be included in the treatment station. However, the greatest advantage in enclosing the modules at the treatment station in a housing is achieved when more than one of the modules requires powder recovery, so that a single powder recovery system can be used. With the preheat/spray technique, all powder that is deposited on the armature is fused, so there can be no cleaning step. Therefore, the only step requiring powder recovery is the spray coating step itself. Thus the use of a housing with the preheat/spray technique does not present as great an advantage as in the case of the fluidized bed electrostatic technique. However, the use of a housing provides at least some advantage in any case, insofar as most coating techniques operate better when the ambient conditions can be closely controlled, as in a housing.

The cleaning module according to the invention includes a vacuum chamber which is subdivided by vertical walls into a plurality of openings, and preferably a plurality of channels or plena, through which air can be drawn. The armature to be cleaned is passed over the cleaning module at a distance at which the airflow into each respective opening or plenum is most effective for powder removal. The different plena are parallel to one another and vertical, but the openings preferably are arranged at an oblique angle relative to the direction in which the armature travels past them.

The invention also includes a handling system for removing the armature from the armature production line, inserting it into the treatment station and moving it past the various modules in the treatment station, withdrawing it from the treatment station, and returning it to the armature production line. Preferably, the handling system handles several armatures at one time. The handling system includes unique, self-locking gripping means, as well as automatic masking means, which are preferably integral with one another.

The apparatus of the invention can be used for high or low volume operation.

A preferred embodiment of apparatus according to the invention will be described in connection with FIGS. 1–7.

Apparatus 10 according to the invention transfers armatures 12 between conveyor 11 of an armature processing line and a treatment station 20. In treatment station 20, armatures are electrostatically coated by coating module 21, selected armature surfaces are cleaned to remove unwanted powder at cleaning module 22, and the armature is heated to stabilize the deposited powder at precuring module 23.

Armatures 12 to be coated are first cleaned in a precleaning station (not shown) to remove any dirt or other contaminants. Shafts 13, 13' of each armature are then rested in oppositely facing V-seats 17, 17' of respective conveyor transport chains 18, 18' of conveyor 11. Conveyor 11 then transports armatures 12 to transfer device 15.

Transfer device 15 grips armatures 12 and automatically masks shafts 13, 13' as will be described in more detail below. The gripped and masked armatures 12 are then transferred into treatment station 20 through window 106 for coating, cleaning and precuring. Once these operations have been carried out, the coated armatures 16 are returned to the conveyor 11 and transported to downstream stations (not shown) for carrying out further coating operations and other armature production operations. Such operations may include further cleaning which might not be possible in the presence of the masks. The operations may also include curing in an appropriate oven (not shown).

A plurality of armatures are transferred batch-wise continuously by transport chains 18, 18' to position and align armatures 12 over a platform 19. Initially, platform 19 is rotated 90° from the position in which it is shown in FIG. 1. Platform 19 is positioned between transport chains 18, 18' and includes semi-cylindrical seats 100 which become aligned with armatures 12 positioned by the conveyor 11.

Once armatures 12 have been aligned over seats 100 by conveyor 11, a lifting device 101 causes the platform to translate upwards between transfer chains 18, 18' in order to engage the armatures 12 in seats 100 and then to lift shafts 13, 13' off supporting V-members 17, 17'.

After platform 19 carrying armatures 12 has cleared transport chains 18, 18', lifting device 101 rotates platform 19 through 90° to the angular orientation shown in FIG. 1. Further translation of platform 19 with such an orientation positions armatures 12 between separated arms 30, 31 of transfer device 15. In this position of platform 19, armature shafts 13, 13' are aligned with respective oppositely-facing holding assemblies 40, 41 mounted on arms 30, 31. After platform 19 has aligned armatures 12 with holding assemblies 40, 41 of arms 30, 31, locking device 19' with counterpart semicylindrical seats 100' (aligned with the rotated position of platform 19) descends towards platform 19. Locking device 19' comes to a stop when its seats 100' abut and press against of the armatures 12, thereby locking armatures 12 in alignment with holding assemblies 40, 41 of arms 30, 31.

Transfer device 15 includes a support assembly 102 fixed to a slide 103 which can translate on guides 104, 104'. These guides are parallel to an axis 105 along which the centers of armatures 12 are translated into treatment station 20 through window 106 in housing 24. Arms 30, 31 are slidably mounted on respective sides of a crossbar 32 which is part of support assembly 102, so that arms 30, 31 can be translated perpendicular to axis 105 in order to move them farther apart or closer together. Each arm is associated with a respective translating assembly 108, 108' for effecting such translation.

Each assembly 108, 108' has two grippers 109, 109' aligned with the portions of arms 30, 31 to be gripped. Grippers 109, 109' are carried by respective slides 110, 110' which move perpendicular to axis 105 on guides 111, 111' attached to a frame structure (not shown).

Assemblies 108, 108' can be translated towards axis 105 to cause grippers 109, 109' to grip arms 30, 31, after which the assemblies 108, 108' can be translated in the other direction to separate arms 30, 31 so that platform 19 can be positioned for aligning shafts 13, 13'. Assemblies 108, 108' can then be translated towards axis 105 again in order to close arms 30, 31 and to cause holding assemblies 40, 41 to engage and grip their corresponding aligned armature shafts 13, 13', as described in more detail below. At the same time, masking members are also applied to shafts 13, 13', also as described below. Grippers 109, 109', can then be released and assemblies 108, 108' can be translated away from axis 105 to a rest position.

While it is possible to include mechanisms internal to transfer device 15 to perform the functions of translating assemblies 108, 108', transfer device 15 is intended to be interchangeable to accommodate different sized workpieces, as described below. Because the translation of arms 30, 31 must be precise, it is better to have precision translating assemblies 108, 108' permanently mounted (not shown) to the frame of apparatus 10. Not having to include precision translation mechanisms in each interchangeable transfer device 15 also reduces the expense of providing multiple interchangeable transfer devices 15.

Arms 30, 31 are hollow and have respective perpendicular extensions 33, 34 which are also hollow. The extensions are slidably supported in guides 35, 36 of tubular cross portion 32. Tubular cross portion 32 is part of a tube 37 forming part of support assembly 102.

A hollow cup member 38 is fixed by means of bolts 39 to an interior block of tube 37. A threaded portion 300 of cup 38 is engaged by sleeve 301, removably fixing tube 37 to a further tube 302, allowing for quick substitution of transfer device 15 as described in more detail below. Tube 302 is fixed to an extension tube 303 by means of thread 304. The extension tube 303 is fixed to slide 103 for translation of the insert device 15 parallel to axis 105 in order to insert armatures 12 into, and withdraw armatures 12 from, treatment station 20.

A cylindrical member 305 mounted inside tube 302 has a passage 306 forming an air cylinder and further passages for seating bushings 307, 308, supporting locking pins 309, 310 capable of sliding parallel to axis 105.

Taps 311, 312 in abutment with the end faces of cylindrical member 305 act as airtight bottoms for air cylinder 306. A second cylindrical member 313 acts as a spacer between tap 312 and a third cylindrical member 314. Third cylindrical member 314 supports a pneumatic motor 315 having an output shaft 316. Second cylindrical member 313 has a central bore 317 into which motor shaft 316 extends. Motor shaft 316 is connected to a further shaft 318. Further bores 319 of second cylindrical member 313 provide room for air fittings 320, 321 required to connect locking pins 309, 310 to flexible air tubes 322, 323.

Taps 311, 312 and cylindrical members 305, 313, 314 are all in sequential abutment, forming a sandwich assembly which is kept together by means of bolts (not shown) passing through mating bores of each of these members. The heads of the bolts are in abutment against tap 311 while their end portions engage threaded bores (not shown) of third cylindrical member 314. This assembly is fixed to tube 302 by pushing tap 311 against shoulder 324 of tube 302 using ring 325.

Piston member 326 is slidably mounted in the bore 306 of cylindrical member 305. Pins 309, 310 are fixed to piston 326 by means of disk assembly 327. By supplying air to the chambers formed in bore 306 by piston 326, pins 309, 310 can be caused to translate forwards or backwards in bushings 307, 308. When piston 326 is thrust forward (towards cross portion 32), the tips of pins 309, 310 become engaged in precision bores 328 of arm extensions 33, 34 in order to lock the arms in the closed position. Such a locking operation is required to maintain armature shafts 13, 13' gripped by holding assemblies 40, 41 once grippers 109, 109' of assemblies 108, 108' have been released.

Pins 309, 310 are preferably hollow so that air fed through tubes 322, 323 can be supplied to the interiors of extensions 33, 34 and consequently to the interior of arms 30, 31, for reasons to be discussed below. The other ends of tubes 322, 323 communicate with a suitable air supply through the rear end of extension tube 303.

Motor 315 is used to cause rotation of holding assemblies 40, 41 together with armatures 12 as described in more detail below. A bevel gear 329 is mounted at the end of a shaft 330 on bearings 331 of tube 37. Shaft 330 is connected to shaft 318 by means of a quick release cross connection 332. Shaft 318 is mounted to rotate on central bushing 344 of piston 326. The other end of shaft 318 is threadedly connected to motor shaft 316.

Hollow shafts 333, 334 are mounted on bearings 335 of cross portion 32. Shaft 336 is supported in hollow shafts 333, 334 and on bearings 337 of cross portion 32. Keys 338, 339 pass through respective slots 340 of hollow shafts 333, 334 in order to engage respective channels machined along the length of shaft 336.

To rotate shaft 336, bevel gear 341 (fixed to shaft 336) engages bevel gear 329 which is turned by motor 315. Hollow shafts 333, 334 are also caused to rotate by engagement of keys 338, 339 in their respective channels of shaft 336. This causes belt pulleys 342, 343 mounted on the ends of hollow shafts 333, 334 to rotate so that holding assemblies 40, 41 together with armatures can be turned when required, as discussed below.

Slidability of hollow shafts 333, 334 on shaft 336, together with the engagement of keys 338, 339 in their respective channels of shaft 336, allows for translation of hollow shafts 333, 334 when extensions 33, 34 are moved to separate or close arms 30, 31.

During movement of arms 30, 31 toward one another, each shaft end 13, 13' comes into abutment with member 42 of holding assembly 40, 41, fixed to gripping member 43 by means of thread 44. Gripping member 43, slidably mounted in sleeve member 45, is then caused to retract as arms 30, 31 move towards each other, forcing holding assemblies 40, 41 against shafts 13, 13'. Sleeve member 45 is fixed between a shoulder 46 of support member 47 and the shoulder of masking member or shroud 402. Gripping member 43 is provided with a split cylindrical portion 48 which engages a rounded tip portion 49 of fixed sleeve member 45. Portion 48 of member 43 is split in such a way that there are a number of equiaxially spaced-apart portions for engagement with tip portion 49 of sleeve member 45. Portion 48 also has a hollow central core sized to exceed slightly the diameter of shaft 13, 13', and has a frustoconically shaped outer surface whose diameter decreases in a direction away from shaft 13, 13'.

As arms 30, 31 are translated towards each other, split portions 48 of gripping member 43 become wedged between the shaft 13, 13' and tip portion 49 of sleeve member 45 as shaft 13, 13' bears on member 42. Split portion 48 thus serves as a locking cylinder and sleeve member 45 serves as a camming cylinder for locking cylinder 48, generating a frictional gripping force on the shaft 13, 13' which prevents rotation of shaft 13, 13' in relation to gripping member 43. It also prevents lateral movement of shaft 13, 13' in relation to axis 400 and translation of shaft 13, 13' along axis 400. Preloading spring 401 mounted between gripping member 43 and the bottom of sleeve member 45 biases gripping member 43 into abutment with the front portion of masking member 402 when arms 30, 31 are separated and shaft 13, 13' is not bearing on member 42.

The opposite end of masking member 402 is fixed to support member 47 by means of thread 403. Support member 47 can rotate on bearing 404 mounted in a cylindrical seat 405 of arm 30, 31. Belt pulley 406 is mounted on the end of support member 47 for turning shaft 13, 13' together with masking member 402. This is achieved by connecting belt 407 to pulley 342, 343. Belt 407 is also connected to similar pulleys of other holding members 40, 41 on arms 30, 31 so that all shafts 13, 13' together with respective masking members 402 can rotate at the same time and at the same rate.

As discussed above, once assemblies 108, 108' have moved together sufficiently to cause masking and firm gripping of shafts 13, 13' by holding assemblies 40, 41, pins 309, 310 are inserted in bores 328 of extensions 33, 34 to lock arms 30, 31 with assemblies 40, 41 engaged. Assemblies 40, 41 are thus self-locking once they are urged onto shafts 13, 13' by arms 30, 31, and are self-releasing as arms 30, 31 move apart.

When arms 30, 31 and holding assemblies 40, 41 are locked, air is supplied through bores of pins 309, 310 and passes through a central passage 408 of support member 47, then through a bore and slit of member 42 and finally between spaced apart portions of split cylindrical portion 48 in order to fill the inside of masking member 402, creating positive pressure to further prevent the entry of powder particles. Spacing between masking member 402 and shaft 13, 13' creates an annular jet of air that both prevents the entry of powder particles and conforms the coating edge to a required shape. Alternatively, cylindrical portion 48 could be solid instead of split, and could be provided with holes or vents to allow the passage of air.

The internal mechanism of holding assembly 41 has heretofore been described as being identical to that of assembly 40. However, the mechanism does differ in that sleeve member 45 of assembly 41 only is slidably mounted in a passage 409 of support member 47, biased against a spring 410. This translatable mounting allows for compensation for different armature lengths which may be mounted between arms 30, 31.

Holding assembly 41 of arm 31 is otherwise identical to that of the mechanism of holding assembly 40 of arm 30. In particular, assembly 41 has the same mechanism for rotating the grippers and, consequently, armatures 12. This assures that armatures 12 and masks 402 rotate even if one of the gripping members slips on its respective armature shaft 13, 13', as it is unlikely that both gripping members associated with the same armature 12 will slip.

If electrostatic coating is to be used, gripping members 43, sleeve members 45 and support members 47 are preferably made of conductive material, as are arms 30, 31, so that armature 12 can be properly grounded. However, masking members 402 are presently made of nonmetallic material to avoid attracting the deposition of powder during the coating cycle.

Once the armatures have been gripped and masked by holding assemblies 40, 41, slide 103 can be translated by means of belt 112 connected to a programmable motor drive (not shown), so that transfer device 15 moves armatures 12 along axis 103 in order to pass through window 106 into treatment station 20.

To allow processing of armatures 12 having different shaft diameters, handling device 15, including arms 30, 31, cross portion 32 and tube 37, can be removed as a unit by simply releasing threaded sleeve 301. A substitute handling device having masking members and gripping parts of the required size can then be rapidly mounted on tube 302 with relative ease and without excessive downtime of apparatus 10. Mounting of a substitute handling device is a very simple operation which only requires alignment of cup 38 with tube 302, alignment of members forming cross connection 332 and turning of threaded sleeve 301.

Once handling device 15 has been dismounted, it can be converted for processing other armature sizes. This can be achieved by simply unscrewing masking member 402 from support member 47 in order to dismount and substitute all the internal parts required for gripping the armature shafts of differing sizes. In addition, the placement of all of the working mechanisms of transfer device 15 internally of transfer device 15 (including the mechanisms of holding assemblies 40, 41) protects the working mechanisms from powder contamination. The placement of slide 103 and its drive 104, 104', 112 outside treatment station 20 similarly protects those mechanisms from contamination.

Figure 5:
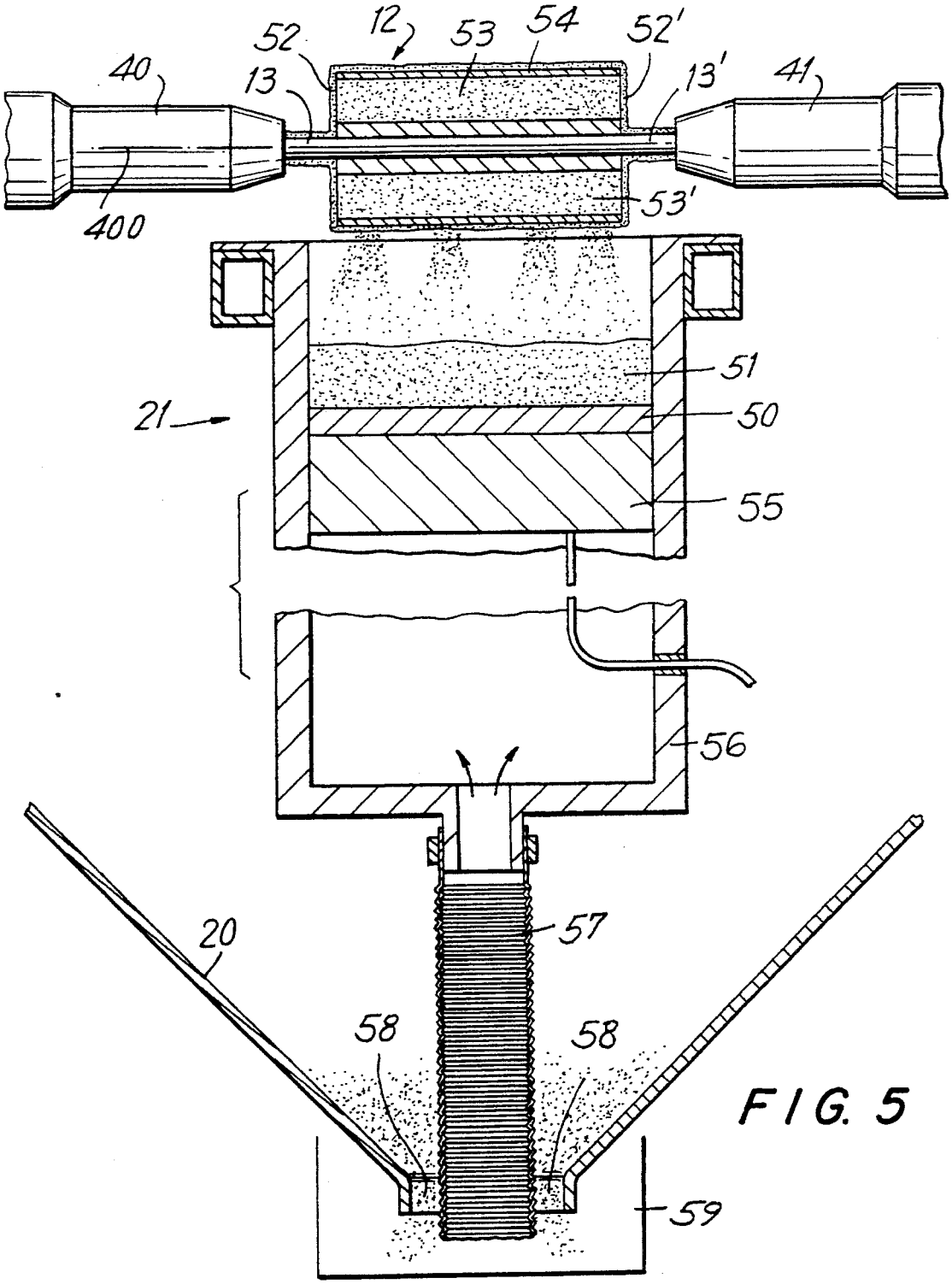
FIG. 5 is a fragmentary cross-sectional view of a module within the treatment station of FIG. 2, taken from line 5—5 of FIG. 2.

FIG. 5 shows an armature 12 positioned at electrostatic fluidized bed coating module 21 by means of holding assemblies 40, 41. Positioning of armature 12 in relation to module 21 requires that the armature center be placed at a predetermined distance above a porous plate 50 which supports coating powder 51. This can be achieved by translating slide 103 on guides 104, 104' so that the armature centers move along axis 105 until a predetermined path has been traversed. The required distance between axis 105 and porous plate 50 is determined empirically for each armature size to be coated. Once such information has been obtained, adjustment means (not shown) can be used to change the position of the coating module 21 to obtain the required distance between the porous plate 50 and axis 105.

Once armature 12 (or more correctly the plurality of armatures 12 carried by transfer device 15) has been precisely positioned at coating module 21, a required voltage is applied to electrode 55 in order to create electrostatic attraction lines leading to the grounded armature. At the same time, a flow of air passes from enclosure 56 (enclosure 56 is filled by tubing 57) through electrode 55 where it is ionized, and then through porous plate 50. In this way, the air charges powder 51 and also fluidizes it (causes continuous movement of the powder particles near porous plate 50). By means of the electrostatic attraction lines leading to armature 12, the particles are accelerated towards the armature so that coating can be accomplished in the required cycle time.

During such a cycle time, in order to obtain a complete and uniform coating of armature 12, armature 12 is rotated by actuating motor 315 so that the entire circumference of armature 12 can be evenly exposed to the electrostatically charged powder 51.

Powder 51 leaving porous plate 50 which is not deposited on armature 12 can be recovered by means of passages 58 leading to vacuum recovery chamber 59 situated in the lower part of housing 20. Such a chamber, as discussed below, is also used by cleaning module 22 and therefore collects powder from both modules 21, 22.

The armature surfaces to be coated are the unmasked portions of shafts 13, 13', the stack end faces 52, 52', and the interiors of core slots 53, 53' for receiving the windings. However, powder is also deposited on the outside surface 54 of armature 12. Coating on the outside surface is not required in the finished armature, and may be undesirable, so any powder deposited must be removed by cleaning module 22 prior to precuring by module 23.

Figure 6:
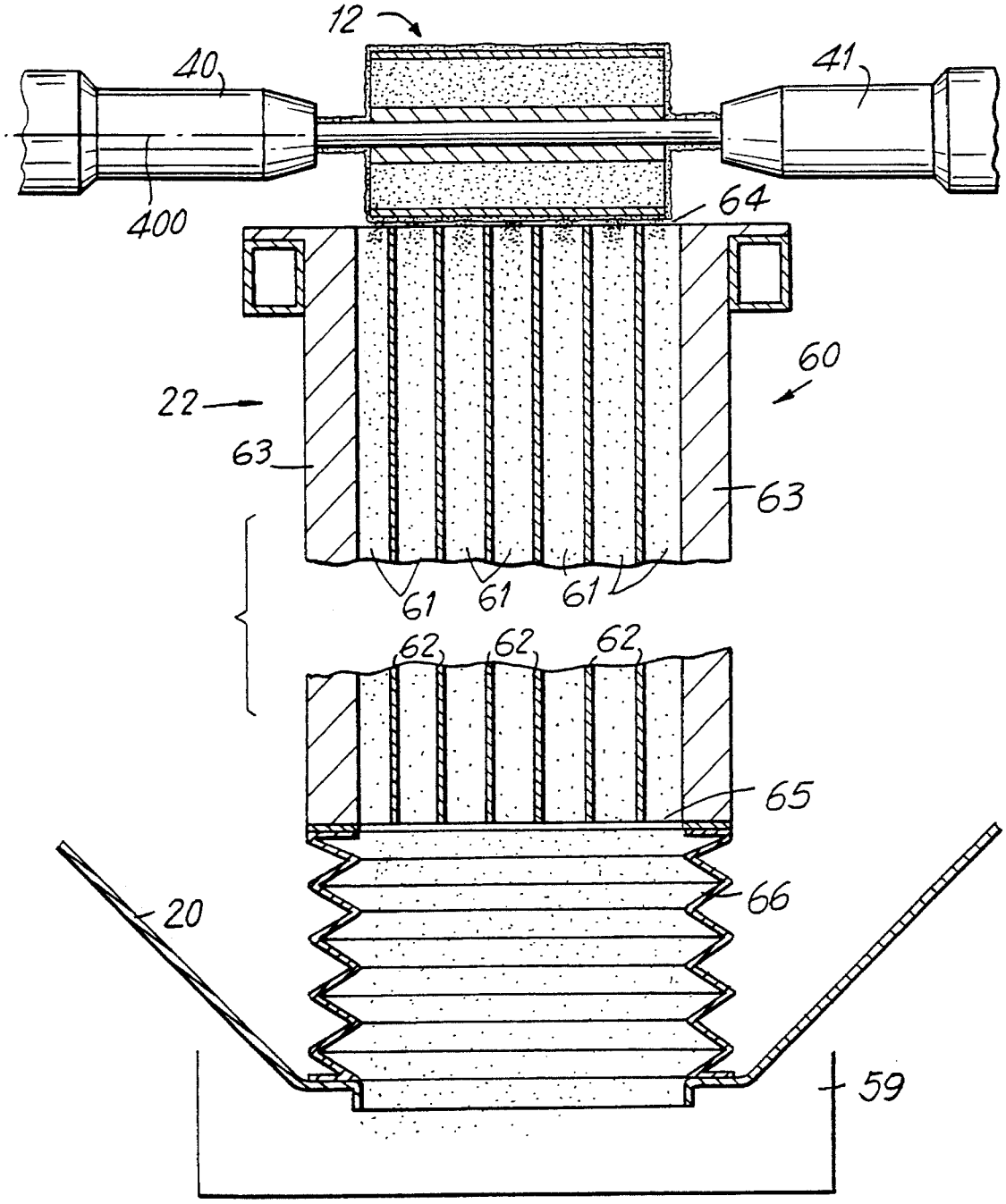
FIG. 6 is a fragmentary cross-sectional view of another module within the treatment station of FIG. 2, taken from line 6—6 of FIG. 2.

FIG. 6 shows coated armature 12 positioned at cleaning module 22 by handling device 15.

Figure 2:
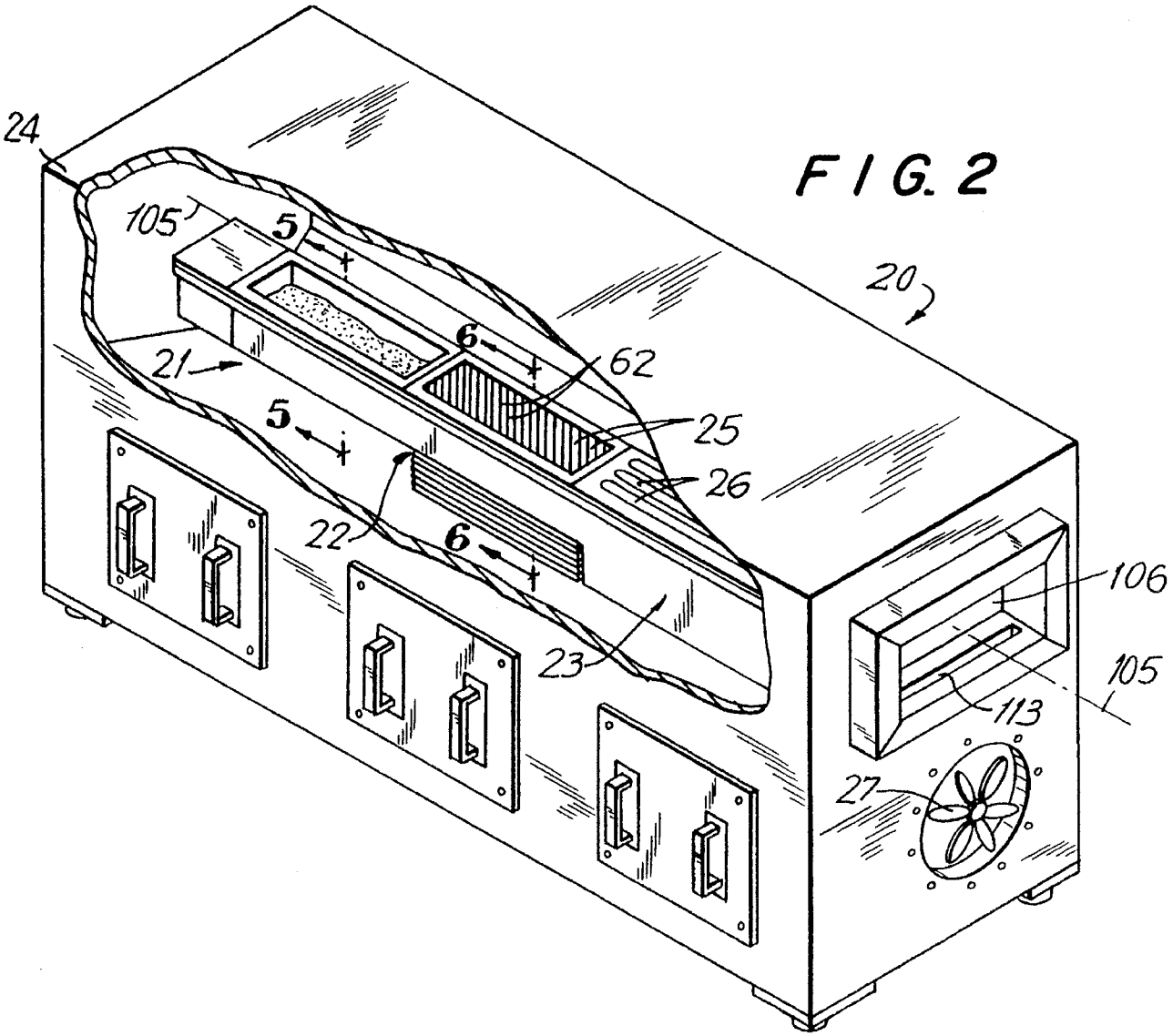
FIG. 2 is a partially fragmentary perspective view of a treatment station according to the invention.
Figure 3A:
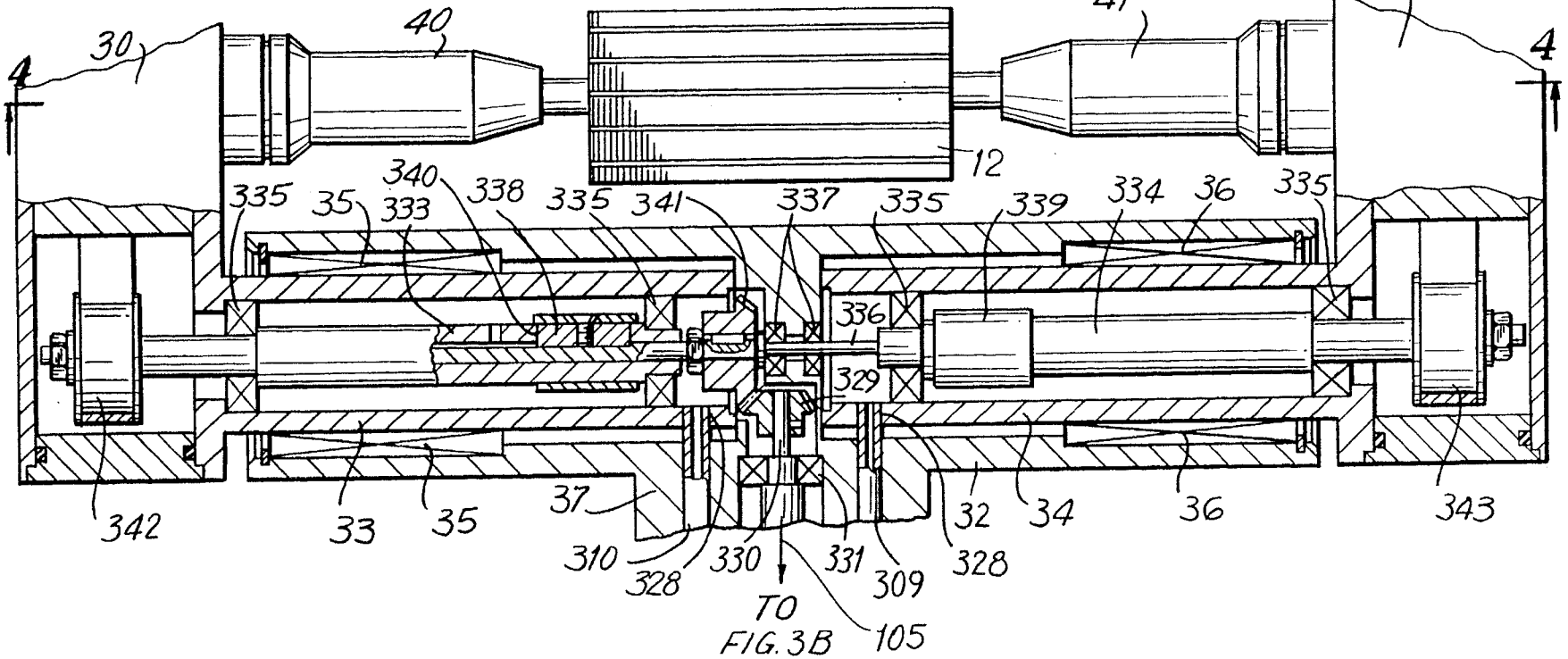
FIGS. 3A and 3B (hereafter collectively FIG. 3) are a fragmentary cross-sectional view of a portion of the transfer device of the apparatus of FIGS. 1–2, taken from line 3—3 of FIG. 1.
Figure 3B:
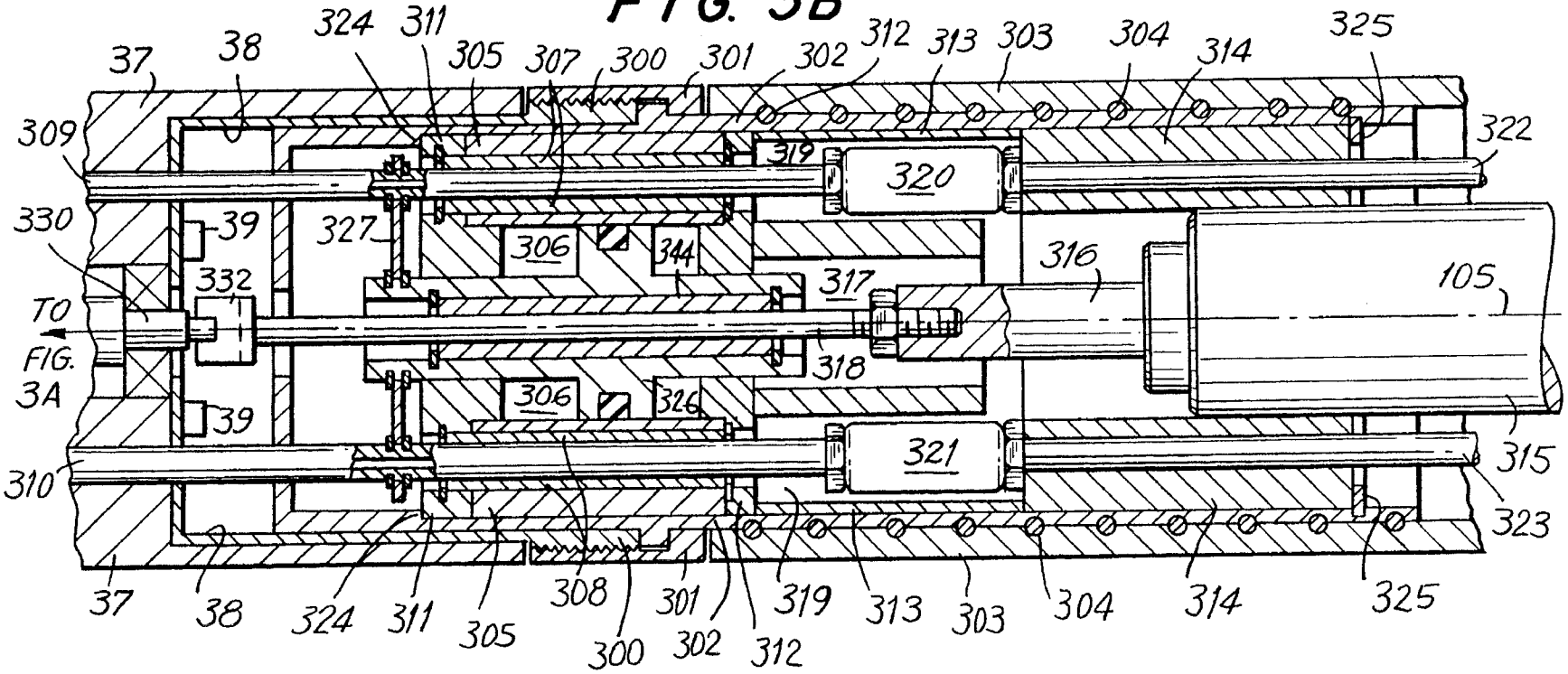
Figure 4A:
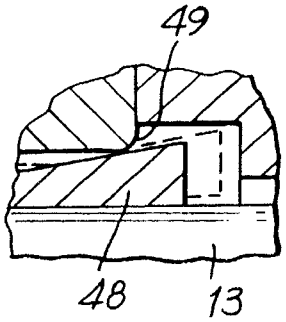
FIG. 4A is a enlarged view of a portion of FIG. 4 within the area of FIG. 4 delimited by circle A.
Figure 4:
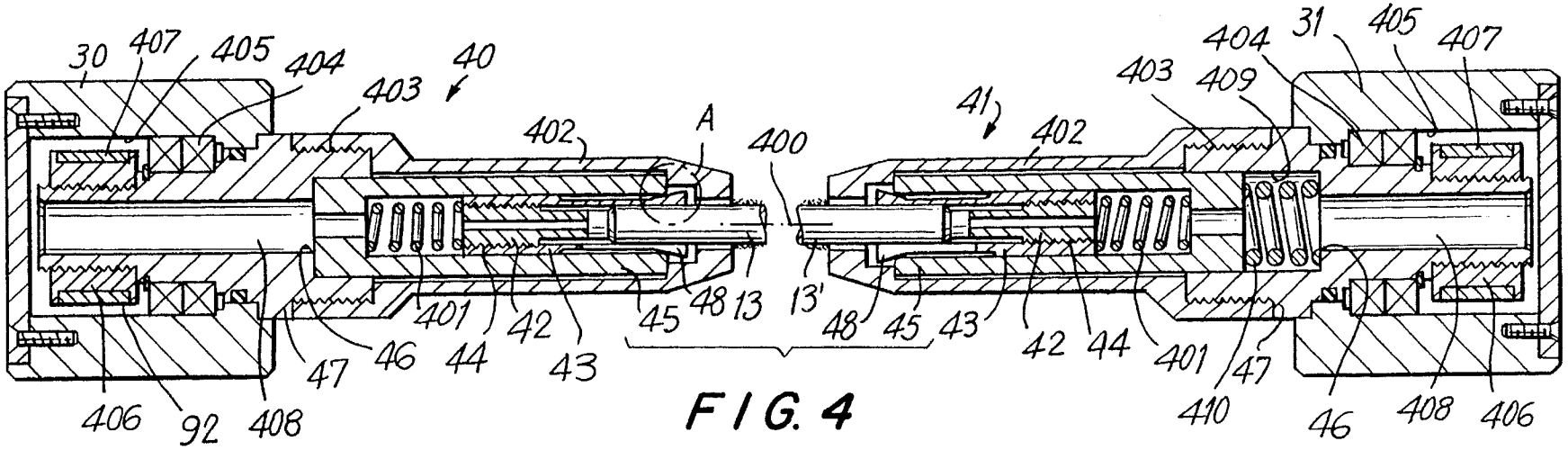
FIG. 4 is a fragmentary cross-sectional view of a further portion of the transfer device of the apparatus of FIGS. 1–3, taken from line 4—4 of FIG. 3.

Cleaning module 22 includes an upstanding enclosure 60 divided into a number of channels or plena 61 formed by means of equally spaced dividers 62. The vertical edges of dividers 62 are airtightly fixed to longitudinal walls 63 of enclosure 60. Each divider crosses from one longitudinal wall to the other along a plane which is inclined to a vertical transverse section of enclosure 60, as best seen in FIG. 2. Upward face 64 of enclosure 60 facing armature 12 is open, and consists of a series of equally spaced openings 25 for channels 61. The bottom face 65 of enclosure 60 is similar to upward face 64 and consists of the opposite openings of channels 61. Bottom face 65 of enclosure 60 is connected to vacuum recovery chamber 59 by means of flexible member 66.

Air is drawn in through openings 25, and as it is drawn in, it is subject to an acceleration or increase in speed as it approaches face 64. This is a well-known phenomenon occurring when a fluid flows from a large section to a more reduced section such as the one presented by openings 25.

To dislodge powder 51 and convey it away from the surface of armature 12 by means of vacuum, the air drawn in must reach a minimum speed, such that none of powder 51 would be removed if the air speed were lower. In order to clean portions of armature 12 without removing powder 51 from adjacent portions, the portions to be cleaned must be positioned where the minimum air speed is reached, while portions where powder 51 is not to be removed should not be subject to air having such speeds. Thus in the case of an armature, only the outer surface of the core should be presented to air flow exceeding the minimum speed, and not stack end faces 52, 52' or the reentrant portions of slots 53, 53'.

To obtain efficient cleaning (i.e., complete removal of powder 51 within an acceptable time period), the surface to be cleaned should be presented as near as possible to openings 25 where the air speed is sufficiently high.

Openings 25 are preferably at an oblique angle relative to the direction of travel of armature 12 because, for an armature at the same distance from openings 25, the resistance to air flow caused by the presence of armature 12 is less than it would be with transverse openings, resulting in less of an increase in air speed as suction air flows around armature 12. In the case of armature 12 having slots 53, 53' from which powder 51 is not to be removed, the higher resistance that would be presented if openings 25 were transverse would cause a greater and faster air flow through and near the ends of slots 53, 53' in faces 52, 52', which might cause removal of powder 51 from portions of slots 53, 53' from which powder should not be removed. Oblique openings 25 help avoid that situation.

Furthermore, armature 12 sometimes has a degree of eccentricity of the outer surface in relation to its axis of rotation. This may cause portions of the outer surface to scrape the edges of openings 25. In the case of transverse openings such scraping would affect a larger portion of the surface than it would in the case of oblique openings. During the scraping, there is more obstruction of air running along the armature surface to be cleaned and therefore a greater amount of air would flow through and near the end apertures of slots 53, 53'. For this reason also, oblique openings 25 are preferred to minimize air flow within slots 53, 53'.

Furthermore, oblique openings tend to produce an air flow which is directed parallel to face 64. This contributes to efficient cleaning for extremely restricted portions when positioning armature 12 in relation to face 64. This is particularly desirable for cleaning border regions between coated and uncoated portions. Transverse openings tend to produce an air flow which diverges away from face 64, which is less effective for cleaning.

Oblique openings 25 can be obtained by machining slots on a plate (not shown) which becomes face 64 of enclosure 60. In such a case enclosure 60 would not require dividers 62 to form plena 61, although it may still be desirable to provide such plena 61. Openings formed in the machined plate may be provided with angled edges to direct air flow in desired directions relative to face 64.

For cleaning thicker deposits of powder 51, it may be desirable to scrape the surface to be cleaned to help dislodge powder 51 so that the air flow can carry it away. Such scraping action could be provided by a dedicated scraping element, or armature 12 could be positioned so that its surface scrapes the edges of openings 25. In the latter situation, the edges of openings 25 should deform under the scraping action of armature 12 to avoid jamming of the workpiece and to insure uniform scraping, as well as to allow lower tolerances in positioning armature 12 in relation to face 64. The necessary deformable edges can be provided by flexible dividers 62 which are not fixed for their entire length to walls 63 of enclosure 60, but only along a small portion of their length near bottom face 65 of enclosure 60.

If scraping is used to dislodge powder 51, it is possible to provide transverse rather than oblique openings 25, because the air flow would only be needed to carry away dislodged powder 51. Thus the air speed could be reduced to the point where the danger of removing powder 51 that should not be removed is minimized. Of course, if the edges of transverse openings 25 are used for scraping, they should be deformable, as discussed above.

Similarly, transverse openings could be used, even without scraping, where the workpieces to be cleaned did not have reentrant portions from which one did not want powder 51 removed—e.g., a hollow open-ended cylinder which requires removal of powder 51 from its outer surface while its inner surface remains coated. In this case, air would not pass through the inside of the cylinder even if obstruction of the air flow were caused by unwanted scraping. However, if such a workpiece has end faces on which powder should remain, then obstruction of the air flow by unwanted scraping should be avoided.

Longitudinal openings could also be used, but if they were not used in conjunction with scraping, portions of the workpiece surface over the longitudinal dividers between the openings might not be subjected to sufficient air flow and might remain at least partially coated, unless the workpiece were also translated from side to side.

Armature 12 is positioned at cleaning module 22 by translating slide 103 along guides 104, 104' so that armature 12 moves along axis 105. The required distance between axis 105 and upward face 64 of enclosure 60 is determined empirically for each armature size to be cleaned, depending on whether or not scraping is desired. Once such information has been obtained, adjustment means (not shown) can be used to change the position of enclosure 60, and therefore of upward face 64, in relation to axis 105. In order to remove powder 51 from the entire armature surface, the armature is rotated by actuating motor 315 and translated along axis 105 by translating slide 103 for a predetermined distance.

Once the armature 12 has been cleaned, each armature 12 is positioned at precuring module 23 by translating slide 103 for a further predetermined amount. Precuring module 23 includes heating elements 26 positioned below armature 12 for radiating heat for a required time. During such a time, armature 12 is rotated to expose all its coated portions towards heating elements 26 in order to achieve the required stabilization of powder 51.

With the powder coating stabilized by precuring, it is possible to measure the coating before final curing without disturbing the coating, which is not possible when precuring is not used. If the coating is either too thick or too thin, or is not sufficiently uniform, the armature can be removed from the production line and the precured coating easily removed. The armature can then be recoated. In contrast, removal of a cured coating is very difficult. More significantly, the data obtained by measuring the precured coating can be fed back to coating module 21 to adjust the coating of subsequent armatures 12.

During processing in treatment station 20, negative air pressure relative to ambient atmospheric pressure is maintained in station 20 by conventional means such as fan 27. After processing is complete in station 20, an air barrier (not shown) across opening 106, sliding in slot 113, which is closed during processing in treatment station 20, can be opened and transfer device 15 can be translated out of treatment station 20 until now-coated armatures 16 are aligned with seats 100 of waiting platform 19. Platform 19 and lock device 19' are then translated towards each other to lock armatures 16. Arms 30, 31 translate away from each other by means of assemblies 108, 108'. When arms 30, 31 are separated from each other, the frictional gripping forces holding shafts 13, 13' are gradually overcome so that armatures 16 remain positioned between lock device 19' and platform 19. Once holding assemblies 40, 41 have cleared the ends of shafts 13, 13', platform 19 descends and rotates 90° to place the shaft ends on the V-seats 17, 17' of conveyor 11 for further processing.

Figure 7:
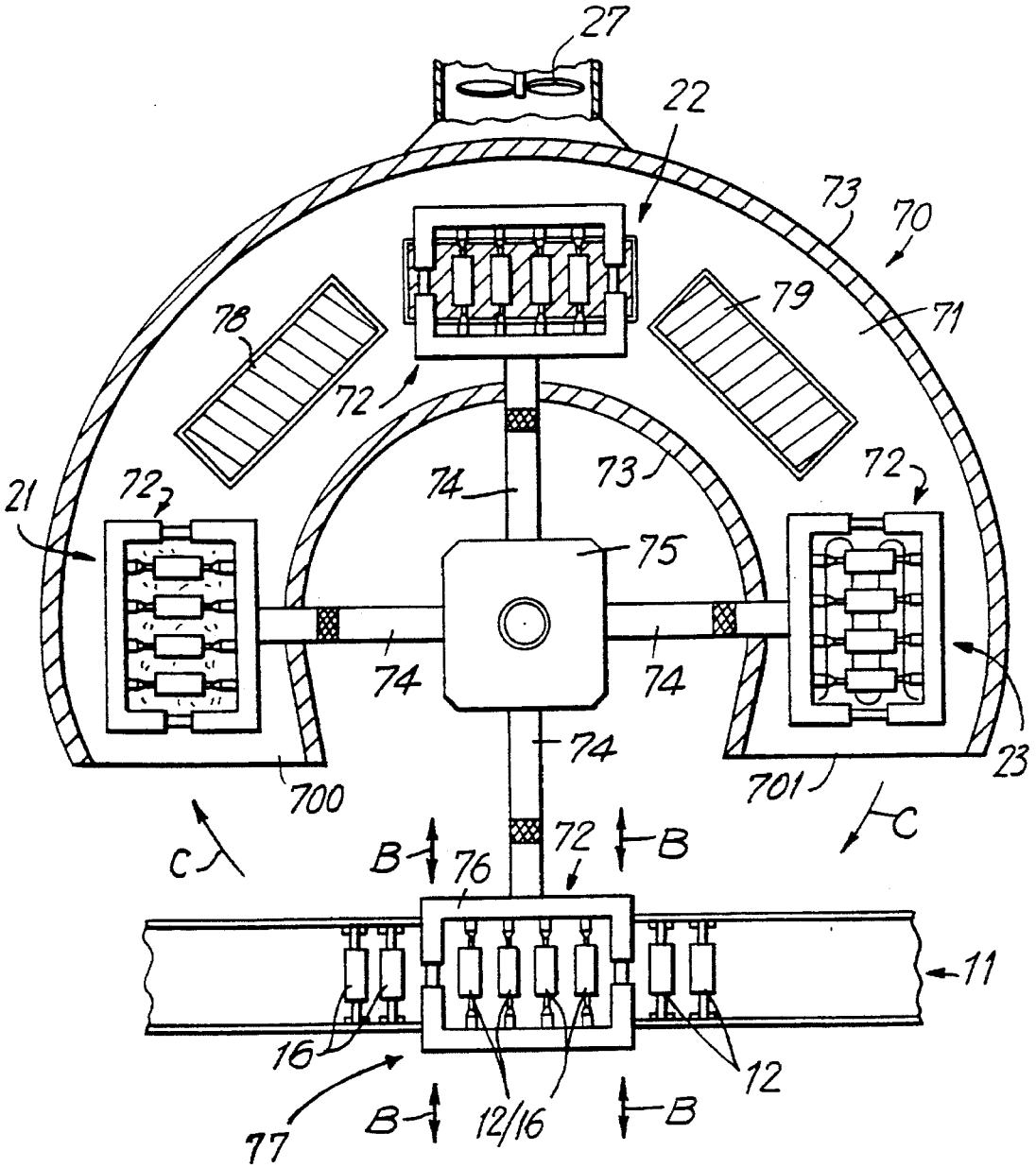
FIG. 7 is a plan view, partly in section, of a second preferred embodiment of apparatus according to the present invention.

In a second preferred embodiment of apparatus 70 according to the invention, illustrated in FIG. 7, linearly-arranged treatment station 20 is replaced by arcuately-arranged treatment station 71, in which modules 21, 22, 23 are arranged at 90° intervals within part-circular housing 73. Four transfer devices 72, each similar to transfer device 15, are mounted on arms 74 radiating from rotating hub 75.

Arms 76 of transfer devices 72 move in the directions of arrows B to grip and mask armatures 12, and to release coated armatures 16, when the respective transfer device 72 is at loading position 77 over conveyor 11. Hub 75 rotates transfer devices 72 in the direction of arrows C, so that each transfer device 72 successively carries its load of armatures in through opening 700, past modules 21, 22, 23 stopping for treatment at each module, before exiting opening 701 and returning to loading position 77. The processing time at each module 21, 22, 23 is arranged to substantially equal the time needed at loading position 77 to unload coated armatures 16 and load a new batch of uncoated armatures 12.

The arcuate arrangement of treatment station 71 allows all modules 21, 22, 23 to operate at the same time, increasing throughput. In addition, more effective cleaning of armatures 12 may be possible because the arcuate arrangement allows room for additional cleaning modules 78, 79 which clean the armatures as they are carried past while hub 75 is rotating.

As discussed above, other workpieces such as stators may be coated by using the principles that underlie this invention. For example in the case of stators, coating must be applied to the internal slots which receive the pole coils. This can be achieved by mounting the stator on a device which engages the inside surface of the pole dove tail portions leaving the coil slots free for deposition of the powder. Such a device would include shafts similar to 13, 13' of armature 12 which can be aligned with holding assemblies 40, 41 of arms 30, 31. Masking in the case of the stator can be carried out using disks which cover portions of the stack face. The masks can be carried by holding assemblies similar to 40, 41 and can be applied to the stator when closing arms 30, 31 to cause gripping of the shafts. In the case of the stator, unwanted powder which is deposited on the outside of the core can be removed by a cleaning device which is similar to that of module 22.

Thus it is seen that apparatus achieving all the objects set out above has been provided. One skilled in the art will appreciate that the present invention can be practiced by other than the described embodiments, which are presented for purposes of illustration and not of limitation, and the present invention is limited only by the claims which follow.

What is claimed is:

1. Apparatus for application of a powdered curable coating to a workpiece, said apparatus comprising:

electrostatic coating means for electrostatically applying said powdered coating to said workpiece;

cleaning means for removing excess or undesired powdered coating from areas of said workpiece after coating of said workpiece by said electrostatic coating means; and:

means for translating said workpiece past said cleaning means in a first direction along a translation plane and for presenting to said cleaning means an area of said workpiece from which it is desired to remove said powdered curable coating; wherein:

said cleaning means comprises a substantially closed vacuum chamber having a face plate machined to provide a plurality of openings from said chamber, said openings being parallel to one another and at an oblique angle relative to said first direction, said face plate being exposed to said area of said workpiece from which it is desired to remove said powdered curable coating.

2. Apparatus for application of a powdered curable coating to a workpiece, said apparatus comprising:

electrostatic coating means for electrostatically applying said powdered coating to said workpiece;

cleaning means for removing excess or undesired powdered coating from areas of said workpiece after coating of said workpiece by said electrostatic coating means; and means for translating said workpiece past said cleaning means in a first direction along a horizontal translation plane and for presenting to said cleaning means an area of said workpiece from which it is desired to remove said powdered curable coating; wherein:

said cleaning means comprises a vacuum chamber having walls substantially perpendicular to said translation plane, and said chamber being divided into a plurality of vacuum plena by a plurality of dividers, said dividers being parallel to one another and perpendicular to said translation plane and having leading edges which are at an oblique angle relative to said first direction.

3. The apparatus of claim 2 wherein said cleaning means further comprises means for scraping said workpiece to dislodge said powdered curable coating.

4. The apparatus of claim 3 wherein said scraping means is resilient.

5. The apparatus of claim 3 wherein at least one of said dividers is said scraping means.

6. The apparatus of claim 5 wherein said at least one of said dividers is resilient.

7. The apparatus of claim 6 wherein said resilient divider is attached to said walls only adjacent its end remote from said translation plane.

8. The apparatus of claim 2 wherein said means for translating and presenting said workpiece comprises means for rotating said workpiece to present a desired face of said workpiece to said cleaning means.

9. Apparatus for application of a powdered curable coating to a workpiece having a shaft, said apparatus comprising:

conveyor means for conveying said workpiece through said apparatus;

a treatment station, said treatment station including coating means; and transfer means for removing said workpiece from said conveyor, for moving said workpiece past said coating means, and for returning said workpiece to said conveyor, said transfer means comprises means for gripping said workpiece, said gripping means comprising:

means for engaging over and holding said shaft, and means for urging said engaging and holding means, said engaging and holding means comprises a locking cylinder having a hollow core having a diameter greater than the diameter of said shaft for admitting said shaft, said locking cylinder having a frustoconical outer surface whose diameter decreases in a direction away from said workpiece, said engaging and holding means further comprising a camming cylinder further from said workpiece than said locking cylinder, whereby:

when said engaging and holding means is engaged over said shaft, and said urging means urges said engaging and holding means over said shaft, said camming cylinder cooperates with said frustoconical surface to wedge said locking cylinder against said shaft, thereby holding said shaft.

10. The apparatus of claim 9 wherein said locking cylinder is a split cylinder.

11. Apparatus for application of a powdered curable coating to a workpiece having a shaft projecting therefrom, said apparatus comprising:

conveyor means for conveying said workpiece through said apparatus;

a treatment station, said treatment station including coating means; and transfer means for removing said workpiece from said conveyor, for moving said workpiece past said coating means, and for returning said workpiece to said conveyor, said transfer means comprises means for automatically masking a portion of said workpiece to prevent deposition of said coating on said portion and means for gripping said workpiece, said automatic masking means and said gripping means are integral with one another, said integral gripping and masking means comprises:

means for engaging over and holding said shaft, said engaging and holding means comprising a locking cylinder having a hollow core having a diameter greater than the diameter of said shaft for admitting said shaft, said locking cylinder having a frustoconical outer surface whose diameter decreases in a direction away from said workpiece, said engaging and holding means further comprising a camming cylinder further from said workpiece than said locking cylinder, and a masking shroud surrounding said engaging and holding means and having an opening for admitting said shaft, said opening having a diameter substantially equal to said shaft diameter for preventing entry of said powdered coating into said shroud; whereby:

when said engaging and holding means is engaged over said shaft, and said urging means urges said engaging and holding means over said shaft, said camming cylinder cooperates with said frustoconical surface to wedge said locking cylinder against said shaft, thereby holding said shaft.

12. The apparatus of claim 11 wherein said locking cylinder is a split cylinder.

13. The apparatus of claim 11 wherein said masking shroud is removable and interchangeable with other masking shrouds having openings of differing diameters, for use in connection with shafts of different diameters.

14. The apparatus of claim 11 further comprising means for maintaining within said masking shroud a positive air pressure relative to ambient atmospheric air pressure.

* * * * *